US009540159B2

(12) United States Patent
Boersma et al.

(10) Patent No.: US 9,540,159 B2
(45) **Date of Patent: *Jan. 10, 2017**

(54) CARTON WITH INSERT

(71) Applicant: Graphic Packaging International, Inc., Atlanta, GA (US)

(72) Inventors: Harmen Boersma, Heerenveen (NL); John Murdick Holley, Jr., Lawrenceville, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 89 days.

This patent is subject to a terminal disclaimer.

(21) Appl. No.: 14/275,204

(22) Filed: May 12, 2014

(65) Prior Publication Data

US 2014/0332429 A1 Nov. 13, 2014

Related U.S. Application Data

(60) Provisional application No. 61/855,305, filed on May 13, 2013.

(51) Int. Cl.
*B65D 71/38* (2006.01)
*B65D 5/44* (2006.01)
(Continued)

(52) U.S. Cl.
CPC ..... *B65D 71/38* (2013.01); *B65B 5/024* (2013.01); *B65D 5/0281* (2013.01); *B65D 5/443* (2013.01);
(Continued)

(58) Field of Classification Search
CPC ..... B65D 71/38; B65D 71/36; B65D 5/5002; B65D 5/5007; B65D 5/50; B65D 5/5009; B65D 5/5004
See application file for complete search history.

(56) References Cited

U.S. PATENT DOCUMENTS 1,925,102 A 9/1933 Levkoff
2,005,924 A 6/1935 Wilson
(Continued)

FOREIGN PATENT DOCUMENTS

CA 873185 6/1971
CA 2 610 666 5/2008
(Continued)

OTHER PUBLICATIONS

International Search Report and Written Opinion for PCT/US2014/069472 dated Apr. 1, 2015.
(Continued)

*Primary Examiner* — Andrew Perreault
(74) *Attorney, Agent, or Firm* — Womble Carlyle Sandridge & Rice, LLP

(57) ABSTRACT

A carton for holding a plurality of containers. The carton can comprise a plurality of panels that extends at least partially around an interior of the carton. The plurality of panels comprises a top panel and a side panel. An insert can comprise a central panel, an inner side panel foldably connected to the central panel, and a crown retention panel foldably connected to the central panel. The top panel can at least partially overlap the central panel, at least a portion of the crown retention panel can be spaced apart from the side panel in the interior of the carton, and the inner side panel can be at least partially in face-to-face contact with the side panel.

36 Claims, 9 Drawing Sheets

(51) Int. Cl.

| | |
|---|---|
| ***B65B 5/02*** | (2006.01) |
| ***B65D 5/50*** | (2006.01) |
| ***B65D 5/54*** | (2006.01) |
| ***B65D 5/32*** | (2006.01) |
| ***B65D 5/468*** | (2006.01) |
| ***B65D 71/36*** | (2006.01) |
| ***B65D 5/02*** | (2006.01) |

(52) U.S. Cl.

CPC ..... *B65D 5/445* (2013.01); *B65D 5/5009* (2013.01); *B65D 71/36* (2013.01); *B65D 2571/0045* (2013.01); *B65D 2571/0053* (2013.01); *B65D 2571/00141* (2013.01); *B65D 2571/00574* (2013.01); *B65D 2571/00666* (2013.01); *B65D 2571/00728* (2013.01); *B65D 2571/00814* (2013.01)

(56) References Cited

U.S. PATENT DOCUMENTS

| | | | |
|---|---|---|---|
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 2/1963 | Robinson et al. |
| 3,128,010 | A | 4/1964 | Forrer |
| 3,133,634 | A | 5/1964 | Bozdar |
| 3,173,596 | A | 3/1965 | Aust et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| 3,300,115 | A | 1/1967 | Schauer |
| 3,332,594 | A | 7/1967 | De Capua |
| 3,346,167 | A | 10/1967 | Schmidt |
| 3,356,279 | A | 12/1967 | Root |
| 3,517,858 | A | 6/1970 | Farquhar |
| 3,533,549 | A | 10/1970 | Gilchrist |
| 3,540,581 | A | 11/1970 | Koolnis |
| 3,825,170 | A | 7/1974 | Aust et al. |
| 3,904,036 | A | 9/1975 | Forrer |
| 4,155,449 | A | 5/1979 | Bryne |
| 4,214,660 | A | 7/1980 | Hunt, Jr. |
| 4,222,485 | A | 9/1980 | Focke |
| 4,256,226 | A | 3/1981 | Stone |
| 4,318,474 | A | 3/1982 | Hasegawa |
| 4,364,509 | A | 12/1982 | Holley, Jr. et al. |
| 4,375,258 | A | 3/1983 | Crayne et al. |
| 4,376,509 | A | 3/1983 | Schaffer |
| 4,378,877 | A | 4/1983 | Botterman et al. |
| 4,396,143 | A | 8/1983 | Killy |
| 4,417,655 | A | 11/1983 | Forbes, Jr. |
| 4,417,661 | A | 11/1983 | Roccaforte |
| 4,538,759 | A | 9/1985 | Dutcher |
| 4,577,762 | A | 3/1986 | Kuchenbecker |
| 4,588,084 | A | 5/1986 | Holley, Jr. |
| 4,605,128 | A | 8/1986 | Rieke |
| 4,621,766 | A | 11/1986 | McClure |
| 4,658,984 | A | 4/1987 | Brunner |
| 4,757,938 | A | 7/1988 | Collins |
| 4,817,866 | A | 4/1989 | Wonnacott |
| 4,830,267 | A | 5/1989 | Wilson |
| 4,890,440 | A | 1/1990 | Romagnoli |
| 4,949,845 | A | 8/1990 | Dixon |
| 4,967,901 | A | 11/1990 | Wood |
| 4,974,771 | A | 12/1990 | Lavery |
| 5,072,876 | A | 12/1991 | Wilson |
| 5,101,642 | A | 4/1992 | Alexandrov |
| 5,119,985 | A | 6/1992 | Dawson et al. |
| 5,137,211 | A | 8/1992 | Summer et al. |
| 5,219,229 | A | 6/1993 | Sengewald |
| 5,249,681 | A | 10/1993 | Miller |
| 5,261,594 | A | 11/1993 | Brown et al. |
| 5,297,725 | A | 3/1994 | Sutherland |
| 5,320,277 | A | 6/1994 | Stout et al. |
| 5,333,734 | A | 8/1994 | Stout et al. |
| 5,350,109 | A | 9/1994 | Brown et al. |
| 5,425,474 | A | 6/1995 | Dalea et al. |
| 5,482,185 | A | 1/1996 | McNaughton |
| 5,482,203 | A | 1/1996 | Stout |
| 5,505,372 | A | 4/1996 | Edson et al. |
| 5,577,612 | A | 11/1996 | Chesson et al. |
| 5,588,585 | A | 12/1996 | McClure |
| 5,597,114 | A | 1/1997 | Kramedjian et al. |
| 5,622,309 | A | 4/1997 | Matsuda et al. |
| 5,664,683 | A | 9/1997 | Brody |
| 5,690,213 | A | 11/1997 | Matsumura |
| 5,690,230 | A | 11/1997 | Griffith |
| 5,794,778 | A | 8/1998 | Harris |
| 5,826,783 | A | 10/1998 | Stout |
| 5,873,516 | A | 2/1999 | Boggs |
| 5,875,961 | A | 3/1999 | Stone et al. |
| 5,881,884 | A | 3/1999 | Podosek |
| 5,921,398 | A | 7/1999 | Carroll |
| 5,924,559 | A | 7/1999 | Carrel et al. |
| 5,927,498 | A | 7/1999 | Saam |
| 6,050,402 | A | 4/2000 | Walter |
| 6,149,009 | A | 11/2000 | Denola |
| 6,170,741 | B1 | 1/2001 | Skolik et al. |
| 6,176,419 | B1 | 1/2001 | Holley, Jr. |
| 6,250,542 | B1 | 6/2001 | Negelen |
| 6,283,293 | B1 | 9/2001 | Lingamfelter |
| 6,302,320 | B1 | 10/2001 | Stout |
| 6,409,077 | B1 | 6/2002 | Telesca et al. |
| D459,927 | S | 7/2002 | Flowers et al. |
| 6,471,120 | B1 | 10/2002 | Vogel |
| 6,478,219 | B1 | 11/2002 | Holley, Jr. |
| 6,484,903 | B2 | 11/2002 | Spivey et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |
| 6,631,803 | B2 | 10/2003 | Rhodes et al. |
| 6,669,083 | B2 | 12/2003 | Bates |
| 6,715,639 | B2 | 4/2004 | Spivey |
| 6,752,262 | B1 | 6/2004 | Boriani et al. |
| 6,766,940 | B2 | 7/2004 | Negelen |
| 6,789,673 | B2 | 9/2004 | Lingamfelter |
| 6,848,573 | B2 | 2/2005 | Gould et al. |
| 6,866,186 | B2 | 3/2005 | Fogle et al. |
| 6,902,104 | B2 | 6/2005 | Holley, Jr. et al. |
| 6,905,066 | B2 | 6/2005 | Holley, Jr. |
| 6,918,487 | B2 | 7/2005 | Harrelson |
| 6,926,193 | B2 | 8/2005 | Smalley |
| 6,929,172 | B2 | 8/2005 | Bates et al. |
| 6,932,265 | B2 | 8/2005 | Sax et al. |
| 6,968,992 | B2 | 11/2005 | Schuster |
| 6,969,172 | B2 | 11/2005 | Actis-Datta |
| 6,974,072 | B2 | 12/2005 | Harrelson |
| 6,991,107 | B2 | 1/2006 | Harrelson |
| 6,997,316 | B2 | 2/2006 | Sutherland |
| 7,000,803 | B2 | 2/2006 | Miller |
| 7,073,665 | B2 | 7/2006 | Auclair et al. |
| 7,104,435 | B2 | 9/2006 | Holley, Jr. |
| 7,134,593 | B2 | 11/2006 | Harrelson |
| 7,159,759 | B2 | 1/2007 | Sutherland et al. |
| 7,225,930 | B2 | 6/2007 | Ford et al. |
| 7,422,104 | B2 | 9/2008 | Perkinson |
| 7,478,743 | B2 | 1/2009 | Holley, Jr. |
| 7,604,157 | B2 | 10/2009 | Zammit et al. |
| 7,699,163 | B2 | 4/2010 | Gomes et al. |
| 7,699,215 | B2 | 4/2010 | Spivey, Sr. |
| 8,356,743 | B2 | 1/2013 | Spivey, Sr. |
| 8,387,855 | B2 | 3/2013 | Brand |
| 8,439,194 | B2 | 5/2013 | Spivey |
| 8,453,919 | B2 | 6/2013 | Eckermann |
| 8,496,109 | B2 | 7/2013 | Smalley et al. |
| 8,919,557 | B2 | 12/2014 | Spivey, Sr. |
| 8,967,380 | B2 | 3/2015 | Moncrief et al. |

(56) References Cited

U.S. PATENT DOCUMENTS

| | | | |
|---|---|---|---|
| 2001/0017315 | A1 | 8/2001 | Baroudi |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2003/0006158 | A1 | 1/2003 | Skolik et al. |
| 2003/0136820 | A1 | 7/2003 | Negelen |
| 2003/0141313 | A1 | 7/2003 | Bates |
| 2003/0150759 | A1 | 8/2003 | White, Jr. |
| 2003/0192907 | A1 | 10/2003 | Bates |
| 2004/0040334 | A1 | 3/2004 | Rusnock |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0188508 | A1 | 9/2004 | Holley, Jr. et al. |
| 2005/0023170 | A1 | 2/2005 | Lingamfelter |
| 2005/0092820 | A1 | 5/2005 | Chekroune |
| 2005/0115843 | A1 | 6/2005 | Harrelson |
| 2005/0126947 | A1 | 6/2005 | Holley, Jr. |
| 2005/0167291 | A1 | 8/2005 | Sutherland |
| 2005/0167478 | A1 | 8/2005 | Holley, Jr. |
| 2005/0189405 | A1 | 9/2005 | Gomes et al. |
| 2005/0263574 | A1 | 12/2005 | Schuster |
| 2006/0054522 | A1 | 3/2006 | Kline et al. |
| 2006/0081691 | A1 | 4/2006 | Smalley |
| 2006/0091193 | A1 | 5/2006 | DeBusk |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2006/0231441 | A1 | 10/2006 | Gomes |
| 2006/0231600 | A1 | 10/2006 | Holley, Jr. |
| 2006/0249413 | A1 | 11/2006 | Auclair et al. |
| 2006/0278689 | A1 | 12/2006 | Boshinski et al. |
| 2007/0007325 | A1 | 1/2007 | Suzuki et al. |
| 2007/0029371 | A1 | 2/2007 | Theelen |
| 2007/0108261 | A1 | 5/2007 | Schuster |
| 2007/0131748 | A1 | 6/2007 | Brand |
| 2007/0164093 | A1 | 7/2007 | Spivey et al. |
| 2007/0181658 | A1 | 8/2007 | Sutherland |
| 2007/0205255 | A1 | 9/2007 | Dunn |
| 2007/0210144 | A1 | 9/2007 | Brand |
| 2007/0251982 | A1 | 11/2007 | Brand |
| 2007/0295790 | A1 | 12/2007 | Zammit et al. |
| 2008/0023535 | A1 | 1/2008 | Holley, Jr. |
| 2008/0048014 | A1 | 2/2008 | Bates |
| 2008/0128479 | A1 | 6/2008 | Bates et al. |
| 2008/0257944 | A1 | 10/2008 | Blin |
| 2009/0282843 | A1 | 11/2009 | Brand |
| 2010/0044420 | A1 | 2/2010 | Brand et al. |
| 2010/0122999 | A1 | 5/2010 | Brand |
| 2010/0237138 | A1 | 9/2010 | Bradford |
| 2011/0011924 | A1 | 1/2011 | Spivey et al. |
| 2011/0049228 | A1 | 3/2011 | Brand |
| 2011/0068160 | A1 | 3/2011 | Brand et al. |
| 2011/0290692 | A1 | 12/2011 | Spivey, Sr. |
| 2012/0091021 | A1 | 4/2012 | Smalley |
| 2013/0118942 | A1 | 5/2013 | Smalley et al. |
| 2013/0119122 | A1 | 5/2013 | Spivey, Sr. |
| 2013/0277260 | A1 | 10/2013 | Smalley et al. |
| 2013/0284628 | A1 | 10/2013 | Moncrief et al. |

FOREIGN PATENT DOCUMENTS

| | | |
|---|---|---|
| EP | 0 066 029 | 12/1982 |
| EP | 1 433 714 | 6/2004 |
| EP | 1 698 565 | 9/2006 |
| FR | 2 549 010 | 1/1985 |
| GB | 2 264 101 | 8/1993 |
| JP | 2002-128064 | 5/2002 |
| JP | 2005-255224 A | 9/2005 |
| JP | 2006-111342 | 4/2006 |
| JP | 2007-055630 | 3/2007 |
| JP | 2007-532421 | 11/2007 |
| JP | 2010-149927 | 7/2010 |
| KR | 10-0154124 | 2/1999 |
| KR | 10-0371048 | 8/2003 |
| WO | WO 96/21603 | 7/1996 |
| WO | WO 96/29260 | 9/1996 |
| WO | WO 99/28198 | 6/1999 |
| WO | WO 99/64301 | 12/1999 |
| WO | WO 00/03937 | 1/2000 |
| WO | WO 02/47990 | 6/2002 |
| WO | WO 2004/043790 | 5/2004 |
| WO | WO 2005/051781 | 6/2005 |
| WO | WO 2005/100175 | 10/2005 |
| WO | WO 2006/050210 | 5/2006 |
| WO | WO 2006/050316 | 5/2006 |
| WO | WO 2007/076544 | 7/2007 |

OTHER PUBLICATIONS

International Search Report and Written Opinion for PCT/US2015/017959 dated Jun. 16, 2015.

International Search Report and Written Opinion for PCT/US2014/037640 dated Sep. 12, 2014.

International Search Report and Written Opinion for PCT/US2014/037655 dated Sep. 4, 2014.

International Search Report and Written Opinion for PCT/US2014/037656 dated Sep. 4, 2014.

CARTON WITH INSERT

CROSS-REFERENCE TO RELATED APPLICATIONS

This application claims the benefit of U.S. Provisional Patent Application No. 61/855,305, filed May 13, 2013.

INCORPORATION BY REFERENCE

The disclosures of U.S. patent application Ser. No. 13/419,740, which was filed on Mar. 14, 2012, and U.S. Provisional Patent Application No. 61/855,305, which was filed May 13, 2013, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having a reinforcing insert.

SUMMARY OF THE DISCLOSURE

In general, one aspect of the disclosure is directed to a carton for holding a plurality of containers. The carton can comprise a plurality of panels that extends at least partially around an interior of the carton. The plurality of panels comprises a top panel and a side panel. An insert can comprise a central panel, an inner side panel foldably connected to the central panel, and a crown retention panel foldably connected to the central panel. The top panel can at least partially overlap the central panel, at least a portion of the crown retention panel can be spaced apart from the side panel in the interior of the carton, and the inner side panel can be at least partially in face-to-face contact with the side panel.

In another aspect, the disclosure is generally directed to, in combination, a carton blank and an insert for forming a carton for holding a plurality of containers. The carton blank can comprise a plurality of panels comprising a top panel and a side panel, and the insert blank can comprise a central panel, an inner side panel foldably connected to the central panel, and a crown retention panel foldably connected to the central panel. The top panel at least partially overlaps the central panel, at least a portion of the crown retention panel is for being disposed in a position that is spaced apart from the side panel when the carton is formed from the carton blank and the insert blank, and the inner side panel is disposed at least partially in face-to-face contact with the side panel.

In another aspect, the disclosure is generally directed to a method of forming a carton for holding a plurality of containers. The method can comprise obtaining a carton blank comprising a plurality of panels comprising a top panel and a side panel, obtaining an insert blank comprising a central panel, an inner side panel foldably connected to the central panel, and a crown retention panel foldably connected to the central panel, positioning the insert blank relative to the carton blank so that the top panel at least partially overlaps the central panel and the inner side panel is at least partially in face-to-face contact with the side panel, and forming an interior of the carton at least partially defined by the plurality of panels. The forming the interior of the carton can comprise forming an open-ended sleeve. The forming the interior of the carton can cause at least a portion of the crown retention panel to be disposed in a position that is spaced apart from the side panel in the interior of the carton.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "interior," "outer," "exterior," "lower," "bottom," "upper," and "top" indicate orientations determined in relation to fully erected and upright cartons.

Figure 1:
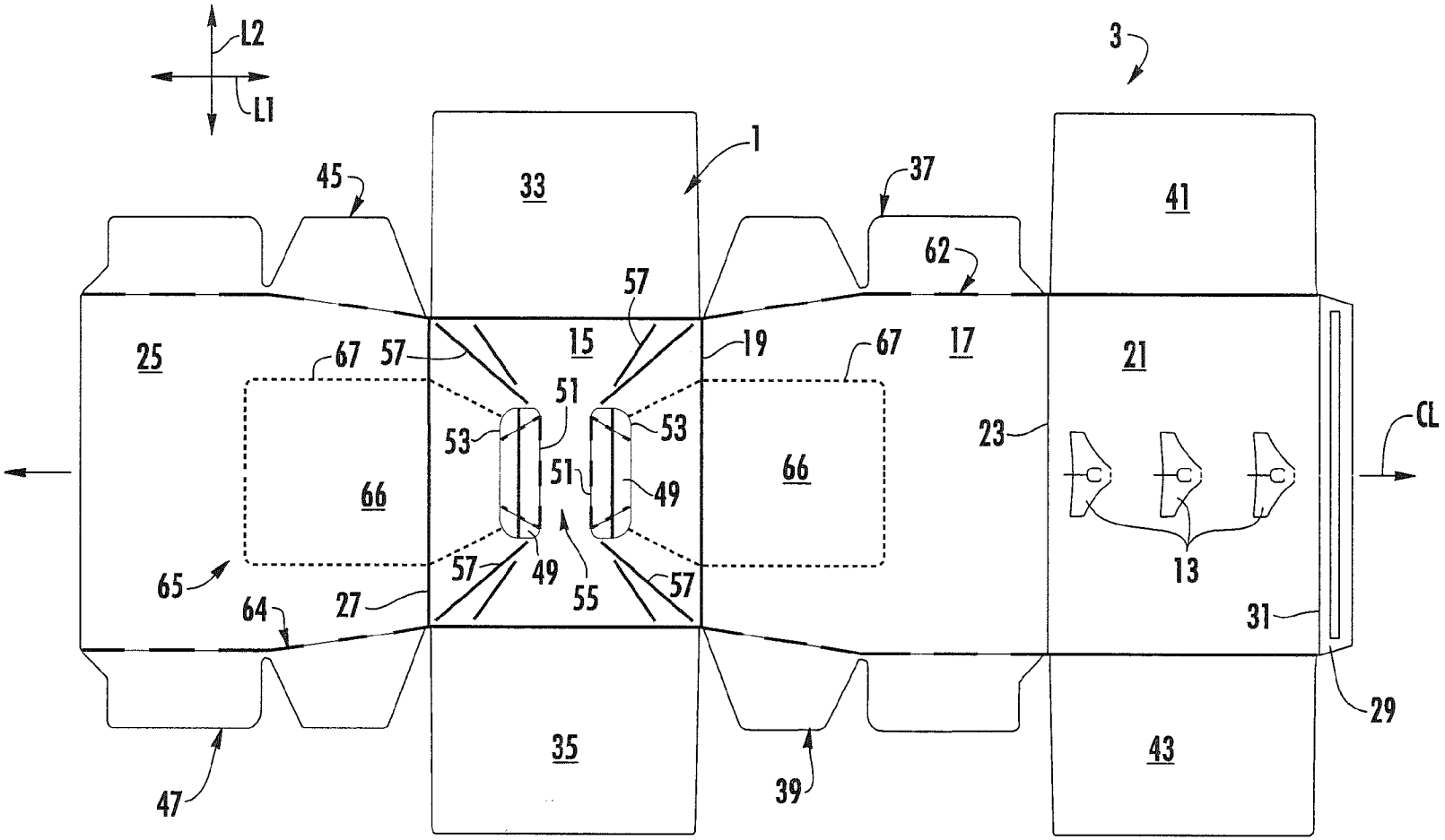
FIG. 1 is a plan view of a carton blank used to form a carton according to an exemplary embodiment of the disclosure.
Figure 3:
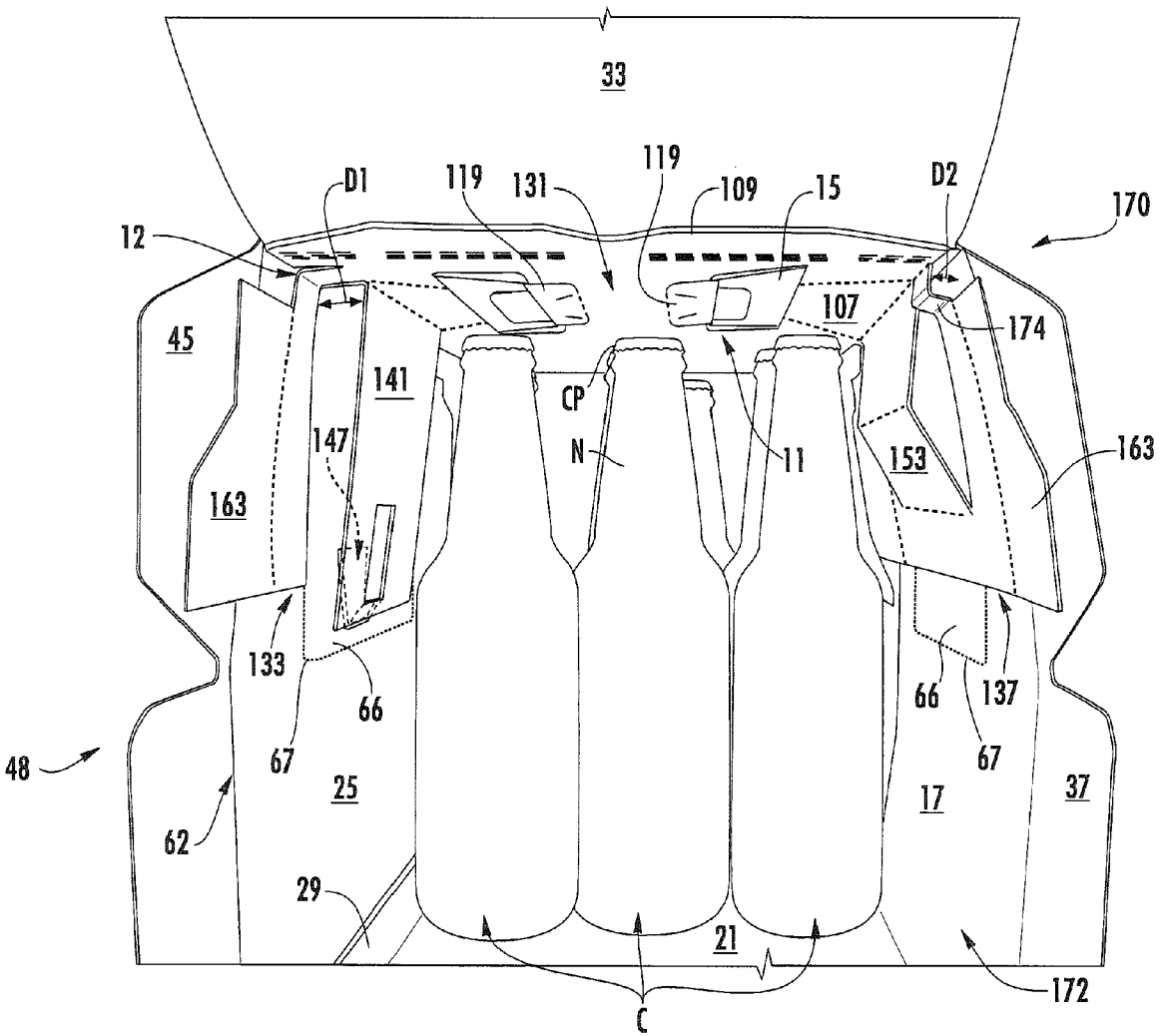
FIG. 3 is a perspective view of a partially-erected carton according to the exemplary embodiment of the disclosure.

FIG. 1 is a plan view of the exterior side 1 of a blank, generally indicated at 3, used to form a carton 5 (FIGS. 4 and 5) according to the exemplary embodiment of the disclosure. The carton 5 can be used to house a plurality of articles such as containers C with necks or upper portions N that are generally narrower than the lower portions of the containers (FIG. 3). The containers C can include tops or caps CP (FIG.

3). In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 3×6, 2×6×2, 3×5, 4×5, 2×9, 2×6, 4×4, etc.). In the illustrated embodiment, the carton 5 includes a handle 11 (FIGS. 4 and 5) for grasping and carrying the carton. As will be discussed below in more detail, the handle 11, is formed from various features in the blank 3. The carton 5 includes a reinforcing insert 12 (FIG. 4) that reinforces and strengthens the handle 11 and reinforces and stabilizes the containers C in the carton.

The blank 3 and carton 5 can have features that are similar or identical to the features described in any of the embodiments disclosed in the above-noted incorporated by reference patent applications, including U.S. patent application Ser. No. 13/419,740, and all related applications. Accordingly, in one embodiment, the carton 5 may have article protection flaps 13 for protecting the at least one article. As noted in the incorporated by reference applications, the article protection flaps 13 are moveable between a first position and a second position placed between adjacent containers C in the carton to reduce movement of the containers in the carton and prevent breakage of the containers. The carton 5 can have other features (e.g., article protection features in the ends of the carton 5 for cushioning one or more of the containers C) without departing from the disclosure.

The carton blank 3 has a longitudinal axis L1 and a lateral axis L2. The carton blank 3 can include a longitudinal centerline CL, as shown in FIG. 1. In the illustrated embodiment, the blank 3 comprises a top panel 15 foldably connected to a first side panel 17 at a first lateral fold line 19. A bottom panel 21 is foldably connected to the first side panel 17 at a second lateral fold line 23. A second side panel 25 is foldably connected to the top panel 15 at a third lateral fold line 27. In the illustrated embodiment, the blank 3 includes an attachment flap 29 foldably connected to the bottom panel 21 at a fourth lateral fold line 31. Any of the top and bottom panels 15, 21 and the first and second side panels 17, 25 can be otherwise shaped, arranged, configured, or omitted, without departing from the disclosure. For example, the blank 3 can alternatively include two top panels cooperating to form a top of the carton 5 or two bottom panels cooperating to form a bottom of the carton. Additionally, the attachment flap 29 could be foldably connected to the second side panel 25 in an alternative embodiment.

Figure 4:
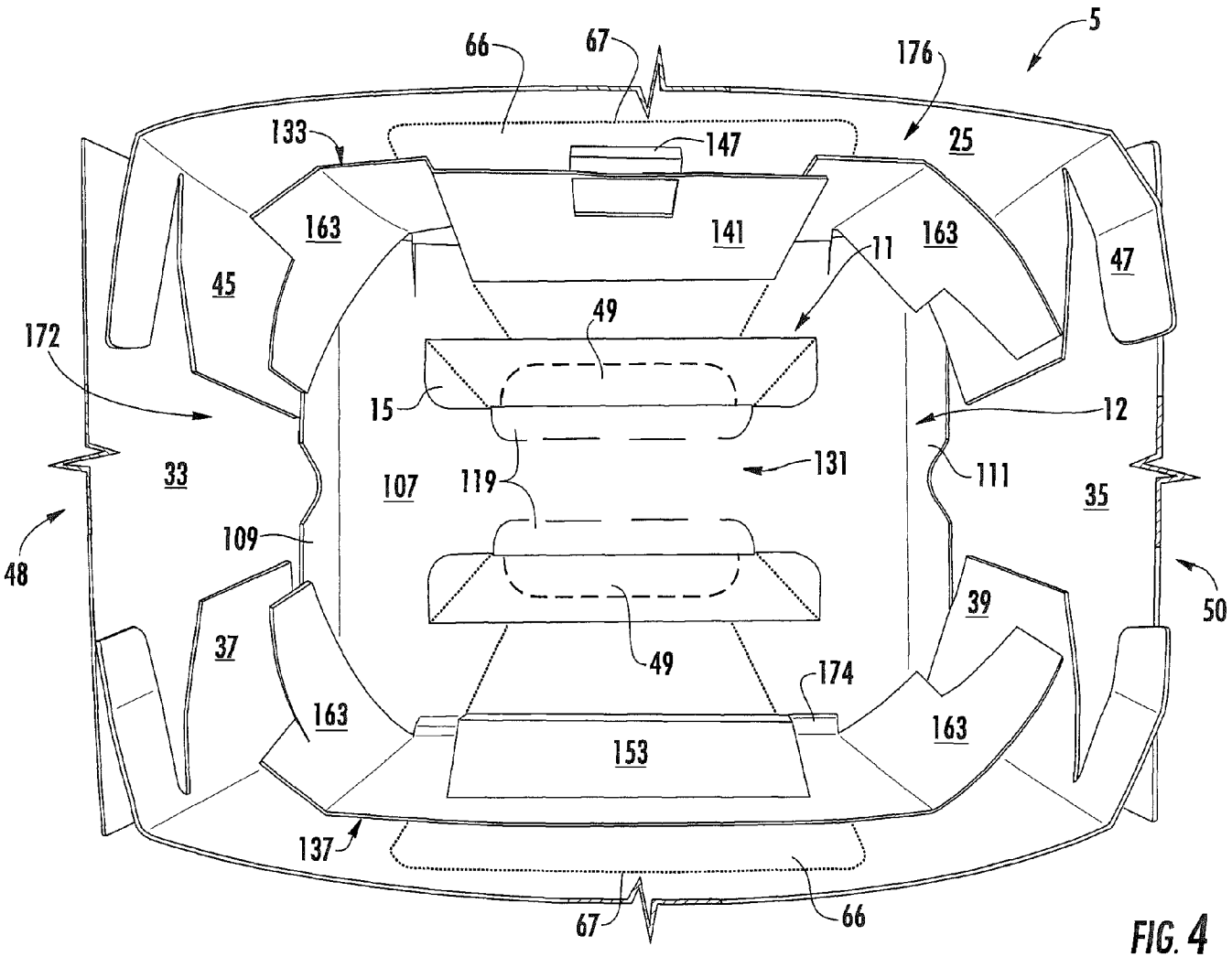
FIG. 4 is a perspective view of the interior of an upper portion of the erected carton according to the exemplary embodiment of the disclosure.
Figure 5:
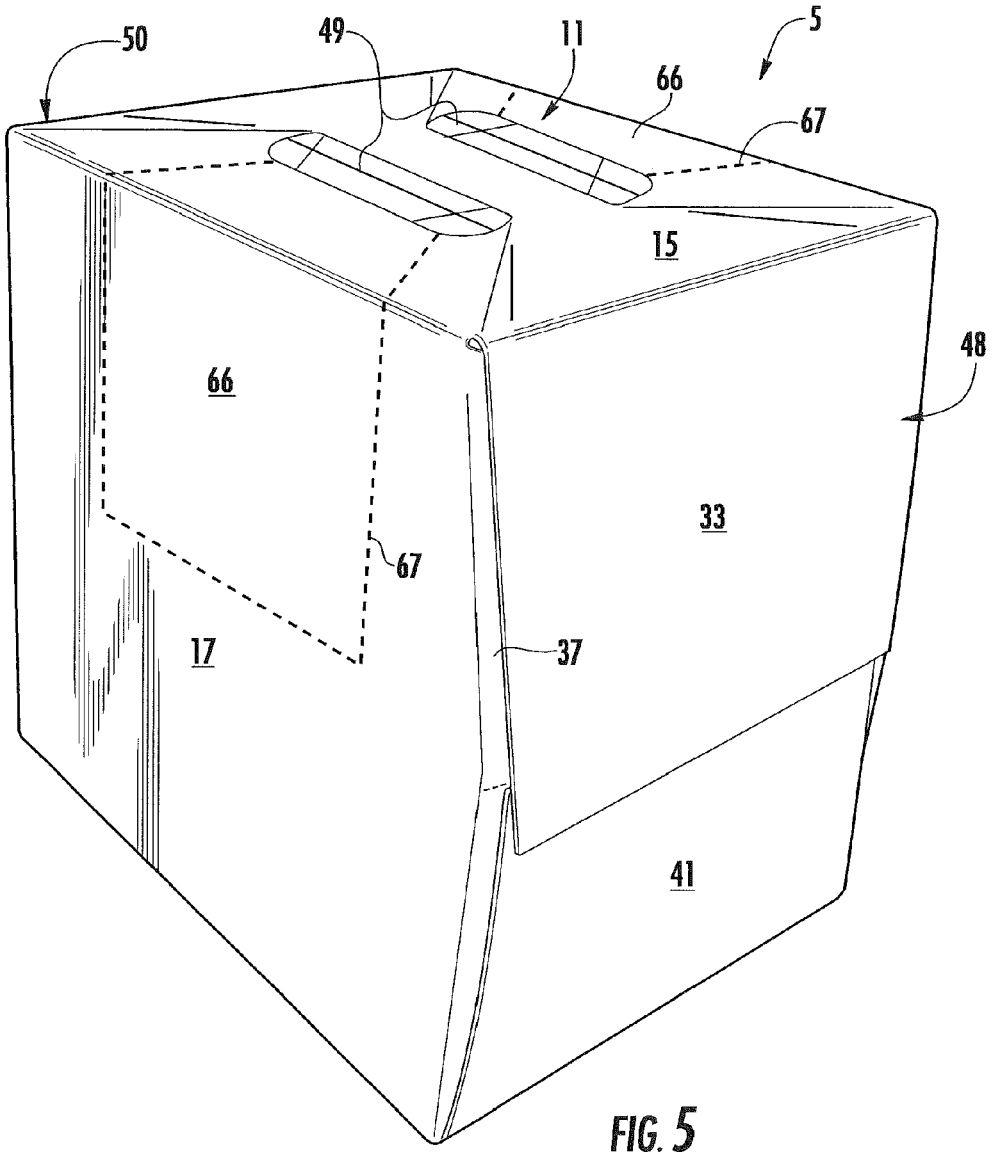
FIG. 5 is a perspective view showing the exterior of carton according to the exemplary embodiment of the disclosure.

The top panel 15 is foldably connected to a first top end flap 33 and a second top end flap 35. The first side panel 17 is foldably connected to a first side end flap 37 and a second side end flap 39. The bottom panel 21 is foldably connected to a first bottom end flap 41 and a second bottom end flap 43. The second side panel 25 is foldably connected to a first side end flap 45 and a second side end flap 47. When the carton 5 is erected, the top and bottom end flaps 33 and 41 and side end flaps 37 and 45 close a first end 48 of the carton, and the top and bottom end flaps 35 and 43 and side end flaps 39 and 47 close the second end 50 of the carton (FIGS. 4 and 5). In accordance with an alternative embodiment of the present disclosure, different flap arrangements can be used for at least partially closing the ends 48, 50 of the carton 5.

In one embodiment, the top and bottom end flaps 33 and 41 and side end flaps 37 and 45 extend along a first marginal area of the blank 3, and are foldably connected at a first longitudinal fold line 62 that extends along the length of the blank. In the illustrated embodiment, the top and bottom end flaps 35 and 43 and side end flaps 39 and 47 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors. Additionally, the top panel 15 can be smaller than the bottom panel (e.g., in the lateral L2 direction) and the longitudinal fold lines can be angled inwardly along the side panels adjacent the top panel 15 so that the ends 48, 50 of the carton are at least partially tapered inwardly near the top of the carton 5.

As shown in FIG. 1, the features that form the handle 11 of the carton 5 include elongate outer handle flaps 49 formed in the top panel 15 and foldably attached to the top panel at a respective arcuate fold line 51. The handle flaps 49 are separable from the top 15 along a respective cut or tear line 53. Additional fold lines and/or scores can extend in the handle flaps 49 to help fold the handle flaps and/or to help the handle flaps deform around the articles in the carton when the handle 11 is actuated to grasp the carton. In the illustrated embodiment, the handle 11 can include an outer grip portion 55 extending between the handle flaps 49 in the top panel 15. In one embodiment, one or more scores 57 can extend in the top panel 15 from the handle flaps 49 to the corners of the carton 5 to help distribute the force of lifting and/or carrying the carton from the top panel 15 adjacent the handle 11 to the corners of the carton. One of the handle flaps 49 could have different features than the other handle flap or could be omitted without departing from the disclosure. The handle 11 could be otherwise shaped, arranged, and/or configured without departing from the disclosure.

According to the illustrated embodiment, a dispenser can be formed by dispenser features including an outer dispenser pattern 65 including two outer dispenser panels 66 at least partially defined by respective outer tear lines 67. The outer tear lines 67 can extend in the respective side panels 17, 25 and into the top panel 15. In the illustrated embodiment, the portions of the tear lines 67 in the top panel 15 can be oblique with respect to the L1 and L2 directions, and the tear lines 67 can include respective ends that are adjacent to or coincident with the cut lines 53 of the respective handle flaps 49. The outer dispenser panels 66 are separable from the top panel and the respective side panels along the respective outer tear lines 67 to form a dispenser opening (not shown) to provide access to the containers C within the carton. The outer dispenser pattern 65 could be omitted or could be otherwise shaped, arranged, and/or configured without departing from the disclosure.

In the illustrated embodiment, the bottom panel 21 includes three article protection flaps 13 foldably connected to the bottom panel and arranged in a single row generally located across the longitudinal centerline CL of the bottom panel. The article protection flaps can be similar to, or the same as, those described in U.S. patent application Ser. No. 13/419,740, filed Mar. 14, 2012, the disclosure of which is hereby incorporated by reference for all purposes as if presented herein in its entirety. The article protection flaps 13 could be omitted or could be otherwise shaped, arranged, positioned, and/or configured without departing from the disclosure.

Figure 2:
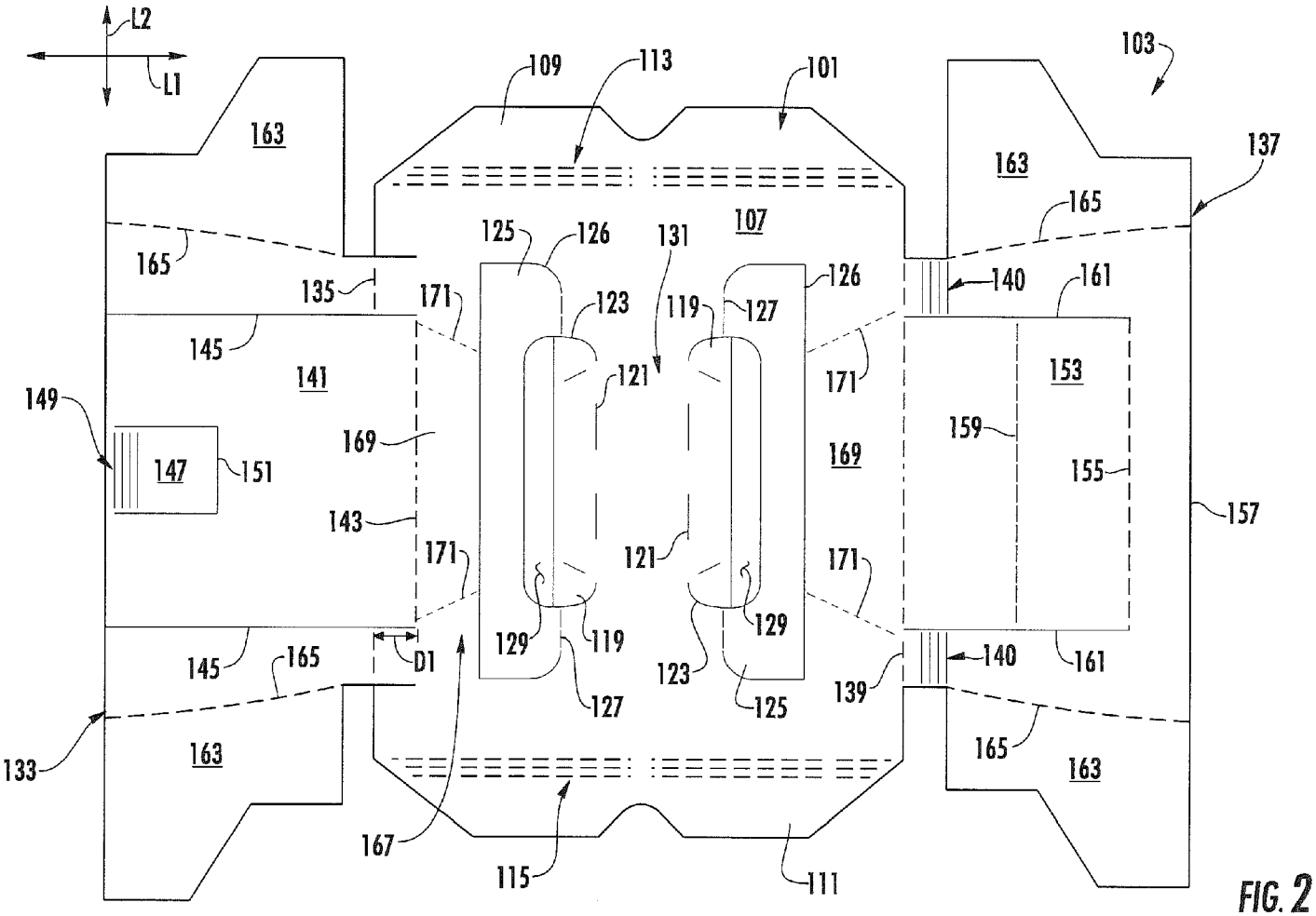
FIG. 2 is a plan view of an insert blank according to the exemplary embodiment of the disclosure.

FIG. 2 illustrates an exterior surface 101 of a reinforcing insert blank 103 used to form the reinforcing insert 12 (FIGS. 3 and 4) for use in the carton 5 according to the exemplary embodiment of the disclosure. As illustrated in FIG. 2, the longitudinal axis L1 and the lateral axis L2 of the reinforcing insert blank 103 are oriented so that the longitudinal axis L1 and the lateral axis L2 of the insert blank 103 comport with the respective longitudinal axis L1 and lateral axis L2 of the carton blank 3 established in FIG. 1. In the illustrated embodiment, the insert blank 103 includes a central panel 107 and two reinforcing end flaps 109, 111 respectively foldably connected to the central panel 107 at opposite ends of the central panel. A first fold line or area 113 (e.g., a plurality of partial cuts) connects the first reinforcing end flap 109 to the central panel 107 at the first end of the insert blank 103, and a second fold line or area 115 (e.g., a plurality of partial cuts) connects the second reinforcing end flap 111 to the central panel 107 at the second end of the insert blank 103. In the illustrated embodiment, each of the fold areas 113, 115 can include several fold lines (e.g., scores, creases, cut-crease lines, etc.). Alternatively, the fold areas 113, 115 can be other lines or areas of weakening for folding the reinforcing end panels 109, 111 relative to the central panel 107 (e.g., a single fold line).

In the illustrated embodiment, the insert blank 103 includes features for forming the handle 11 in the carton 5. The central panel 107 can include inner handle flaps 119 foldably attached to the central panel at a respective lateral fold line 121. The inner handle flaps 119 are separable from the respective reinforcing end flaps 109, 111 along a respective tear or cut line 123 and extends adjacent a opening 129. An inner grip portion 131 can be extended between the inner handle flaps 119 in central panel 107. In one embodiment, the features that form the handle can include two handle reinforcement flaps 125 extending in the central panel 107 and foldably connected to the central panel along respective lateral fold lines 127. The handle reinforcement flaps 125 can be separable from the central panel 125 along respective tear or cut lines 126 and can extend adjacent the respective opening 129. Accordingly, the handle reinforcement flaps 125 can be folded along the lateral fold lines 127 to overlap the grip portion 131, while the edge of the respective handle reinforcement flap 125 that was adjacent the respective opening 129 generally is aligned with the respective lateral fold line 121 of the inner handle flaps 119. The inner handle flaps 119, the fold lines 121, the openings 129, and/or the handle reinforcement flaps 125 could be otherwise shaped, arranged, and/or configured without departing from the disclosure.

In the illustrated embodiment, the insert blank 103 includes a first inner side panel 133 foldably connected to the central panel 107 along a lateral fold line 135 and a second inner side panel 137 foldably connected to the central panel 107 along a lateral fold line 139. In one embodiment, the second inner side panel 137 can include fold areas 140 (e.g., a series of cuts, or another area of weakening) that are spaced apart from the lateral fold line 139. As shown in FIG. 2, the insert blank 103 can include crown retention features for helping to restrain the narrower upper portions N of the containers C. The crown retention features can include a first crown retention panel 141 extending in at least the first inner side panel 133 and foldably connected to the central panel 107 along a lateral fold line 143 (e.g., a partial cut line). In one embodiment, the lateral fold line 143 is spaced apart from the lateral fold line 135 by a distance D1. The first crown retention panel 141 can be separable from the central panel 107 and the first inner side panel along two longitudinal tear or cut lines 145 and can include an attachment flap 147 foldably connected to the first crown retention panel along fold area 149 (e.g., a series of cuts, or another area of weakening). The attachment flap can be separable from the first crown retention panel along a tear or cut line 151.

As shown in FIG. 2, the crown retention features further can include a second crown retention panel 153 extending in at least the second inner side panel 137 and foldably connected to the central panel 107 along the lateral fold line 139. In the illustrated embodiment, the second crown retention panel 153 is also foldably connected to the second inner side panel 137 along a lateral fold line 155 (e.g., a partial cut line), which can be spaced apart from a laterally-extending free edge 157 of the second inner side panel. The second crown retention panel also can include an intermediate lateral fold line 159 that is spaced apart from the lateral fold lines 139, 155. The second crown retention panel 153 can be separable from the second inner side panel 137 along two longitudinal tear or cut lines 161.

In the illustrated embodiment, the crown retention features further can include two corner flaps 163 foldably connected at opposing ends of each of the inner side panels 133, 137 along respective fold lines 165 (e.g., partial cut lines). In one embodiment, the fold lines 165 can be oblique or generally curved. The reinforcing end flaps 109, 111, inner side panels 133, 137, and/or the crown retention features could be otherwise shaped, arranged, and/or configured without departing from the disclosure. For example, the first crown retention panel 141 could include any suitable number of attachment flaps 147 (e.g., more than one). Additionally, the attachment flap 147 and/or the crown retention panels 141, 153 could be rotated with respect to the orientation shown in FIG. 2.

As shown in FIG. 2, the insert blank 103 can include an inner dispenser pattern 167 including inner dispenser portions 169 at least partially defined by respective tear lines 171. The inner dispenser portions 169 are configured to be aligned with the outer dispenser panels 66 of the top panel 15 of the carton blank 3. The tear lines 171 can extend obliquely from the respective lateral fold lines 143, 139 to the respective cut line 126 of the respective handle reinforcement flap 125. In one embodiment, the inner dispenser panel 169 can include at least a portion of the crown retention panels 141, 153. The inner dispenser pattern 167 could be otherwise shaped, arranged, oriented, and/or configured without departing from the disclosure.

Figure 2A:
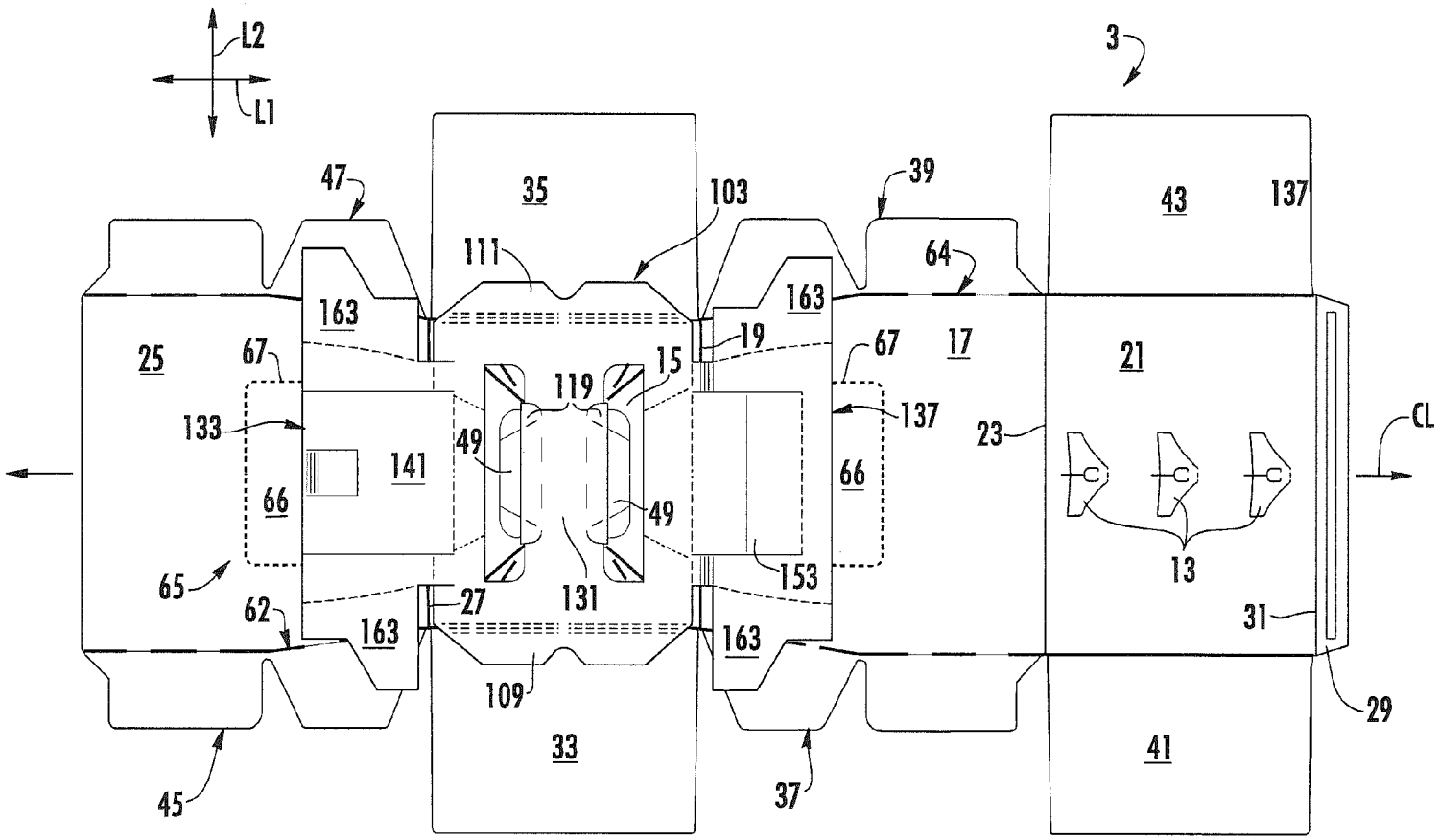
FIG. 2A is a perspective view showing the insert blank attached to the carton blank according to the exemplary embodiment of the disclosure.

As shown in FIGS. 2A-5, in one exemplary embodiment, the carton 5 can be assembled by initially folding the handle reinforcement flaps 125 to overlap the central panel 107 and adhering the insert blank 103 to the top panel 15 and the side panels 17, 25 of the carton blank 3 (FIG. 2A). In the illustrated embodiment, the handle reinforcement flaps 125 are folded along the lateral fold lines 127 to be in face-to-face contact with at least a portion of the exterior surface 101 of the grip portion 131 and the adjacent areas of the central panel 107 to provide an additional layer of material in the handle 11. The handle reinforcement flaps 125 can be glued to the central panel 107 such as by glue strips applied to the central panel 107 and/or the handle reinforcement flaps. In an alternative embodiment, the handle reinforcement flaps 125 could be disposed in face-to-face contact with the interior surface of the insert blank 103.

In the illustrated embodiment, as shown in FIG. 2A, the insert blank 103 can be positioned on the interior surface of the carton blank 3 so that the central panel 107 is at least partially in face-to-face contact with the top panel 15 and the inner side panels 133, 137 are at least partially in face-to-face contact with the respective side panels 25, 17. The reinforcing end flaps 109, 111 can be at least partially in face-to-face contact with the respective top end flaps 33, 35 with the fold areas 113, 115 generally aligned with the respective longitudinal fold lines 62, 64. In the illustrated embodiment, the insert blank 103 can be positioned so that lateral fold line 27 connecting the second side panel 25 to the top panel 15 is generally adjacent to and/or overlaying the lateral fold line 135 connecting the first inner side panel 133 to the central panel 107 and the lateral fold line 143 connecting the first crown retention panel 141 to the central panel 107 is spaced apart from the lateral fold line 27 and the second side panel 25 by at least the distance D1 (FIGS. 2 and 3). In one embodiment, the lateral fold line 139 connecting the second inner side panel 137 and the second crown retention panel 153 to the central panel 107 can be spaced apart from the lateral fold line 19 and the first side panel 17 by a distance D2 (e.g., see FIG. 3). The insert blank 103 could be otherwise positioned on the carton blank 3 without departing from the scope of this disclosure.

In the illustrated embodiment, the central panel 107 and/or the handle reinforcement flaps 125 can be glued to the interior surface of the top panel 15, and the inner side panels 133, 137 can be glued to the respective outer side panels 25, 17, such as by glue strips. In one embodiment, the crown retention panels 141, 153 are not glued to the side panels 25, 17 or the top panel 15 so that the crown retention panels can be positioned independently of the side panels and the top panel. The attachment flap 147 can be glued to the side panel 25. In one embodiment, the attachment flap 147 can be glued to the portion of the dispenser panel 66 that extends in the second side panel 25. As shown in FIG. 2A, the corner flaps 163 can overlap the respective side end flaps 37, 39, 45, 47 and/or the respective side panels 17, 25, and are not glued to the side end flaps or the side panels so that the corner flaps can be positioned independently of the side end flaps and the side panels.

In the illustrated embodiment, when the insert blank 103 is glued to the carton blank 3, the outer handle flaps 49 overlap the inner handle flaps 119 and the openings 129, and the outer grip portion 55 overlaps the handle reinforcement flaps 125 and the inner grip portion 131 to form the handle 11 (FIGS. 3-5). The handle 11 could be otherwise formed without departing from the scope of this disclosure.

In accordance with the exemplary embodiment, the carton blank 3 with insert blank 103 can be further erected into the carton 5 by folding along fold lines 19, 23, 27, and 31 and adhering the attachment flap 29 to the second side panel 25 to form an open-ended sleeve 170 with an interior 172 (FIG. 3). Containers C can be loaded into the interior 172 of the open-ended sleeve 170 (FIG. 3). In one embodiment, the containers C could be loaded before or after closing either or both of the ends 48, 50 of the carton. The sleeve 170 could be otherwise formed without departing from the scope of this disclosure.

In the illustrated embodiment, as the open-ended sleeve 170 is formed, the insert blank 103 is formed into the reinforcing insert 12. Accordingly, as the outer side panels 17, 25 are folded with respect to the top panel 15 (e.g., so that the side panels 17, 25 are generally vertical and the top panel 15 is generally horizontal), the crown retention panels 141, 153 can at least partially separate from the respective inner side panels 133, 137 to extend at least partially into the interior 172 of the open-ended sleeve 170. As shown in FIG. 3, the first crown retention panel 141 can fold along the lateral fold line 143, which is spaced apart from the second side panel 25 and the first inner side panel 133 by the distance D1. Additionally, the first crown retention panel 141 folds along the fold area 149 and the attachment flap 147 separates from the first crown retention flap 141 along the cut line 151. Accordingly, the attachment flap 147 remains attached to the second side panel 25 (FIGS. 3 and 4) to help stabilize the lower portion of the first crown retention panel 141.

As shown in FIG. 3, the second inner side panel 137 can fold along the lateral fold line 139 and the fold areas 140 to form a spacer portion 174 of the second inner side panel while a lower portion of the second inner side panel remains attached to the first side panel 17. The second crown retention panel 153 can fold along the lateral fold lines 139, 159, 155 so that an upper portion of the second crown retention panel extends generally downwardly from the central panel 107 and the top panel 15 and a lower portion of the second crown retention panel extends from the upper portion to the second inner side panel 137 and the first side panel 17. In one embodiment, the upper portion of the second crown retention panel 153 can be generally spaced apart form the first side panel 17 by the second distance D2 (FIG. 3). Accordingly, the second crown retention panel 153 extends between the top panel 15 and the first side panel 17 into the interior 172 of the open-ended sleeve 170. The crown retention panels 141, 153 could be otherwise shaped, arranged, oriented, and/or configured without departing from the disclosure.

In one embodiment, the ends 48, 50 of the carton 5 can be closed as shown in FIGS. 4 and 5. The side end flaps 37, 45 can be inwardly folded to at least partially close the first end 48. In the illustrated embodiment, as the side end flaps are folded, the side end flaps push the corner flaps 163 of the insert 12 and cause the corner flaps to fold along the respective fold lines 165. Accordingly, the corner flaps 163 can extend between the closed end 48 and the respective side panels 17, 25 in the interior 172 of the carton 5 adjacent the respective corners of the carton to help restrain the containers C adjacent the corners of the carton. In the exemplary embodiment, the top end flap 33 can be downwardly folded and the bottom end flap 41 can be upwardly folded to overlap the side end flaps 37, 45 and to further at least partially close the first end 48. As the top end flap 33 is downwardly folded along the longitudinal fold line 62, the reinforcing end flap 109 is folded along the fold area 113 over the first end 48. In the illustrated embodiment, the second end 50 can be closed in a similar or identical manner as the first end 48. The first end 48 and/or the second end 50 could be closed by other steps without departing from the disclosure. The erected carton 5 is shown in FIG. 5 according to the exemplary embodiment.

The erected carton 5 according to the exemplary embodiment is shown in FIG. 4 with the bottom portion of the carton torn away to show the insert 12 in the interior 172 of the carton. The upper portions of the closed ends 48, 50 can be tapered inwardly at least because of the oblique portions of the longitudinal fold lines 62, 64 in one embodiment. In the exemplary embodiment, the tapered upper portions of the closed ends, the crown retention panels 141, 153, and the corner flaps 163 can help provide an upper portion or crown area 176 of the carton 5 that is smaller than the lower portion of the carton to help restrain the narrower upper portions N of the containers C. In one embodiment, the article protection flaps 13 in the bottom panel 21 also help restrain movement of the containers C.

In the illustrated embodiment, a user can grasp and carry the carton 5 at the handle 11 by folding the outer handle flaps 49 and the inner handle flaps 119 into the interior 172 of the carton to form handle openings (not shown) in the top of the carton. The user can grasp the grip portions 55, 131 of the handle 11. The dispenser can be can be opened by tearing one or both of the dispensers panels 66 away along the respective tear lines 67 to form a dispenser opening (not shown) in the top and sides of the carton 5. The tearing of the dispenser panels can be initiated, for example, at the handle openings (not shown). In one embodiment, the portions of the central panel 107 of the insert 12 defined between the tear lines 171 can be glued to the portions of the respective dispenser panels 66 in the top panel 15. Accordingly, when the dispenser panels 66 are torn away, the central panel 107 can tear along the tear lines 171 and the crown retention panels 141, 153 can be pulled out of the interior of the carton to help provide access to the containers C. The first crown retention panel 141 is glued to the dispenser panel 66 in the second side panel 25, and, in one embodiment, the first crown retention panel can be fully removed from the carton with the dispenser panel. Similarly, at least a portion of the second crown retention panel 153 and/or the second side panel 137 can be removed with the dispenser panel 66 in the first side panel 17. The handle 11 and/or the dispenser panels 66 could be otherwise actuated without departing from the disclosure.

Figure 6:
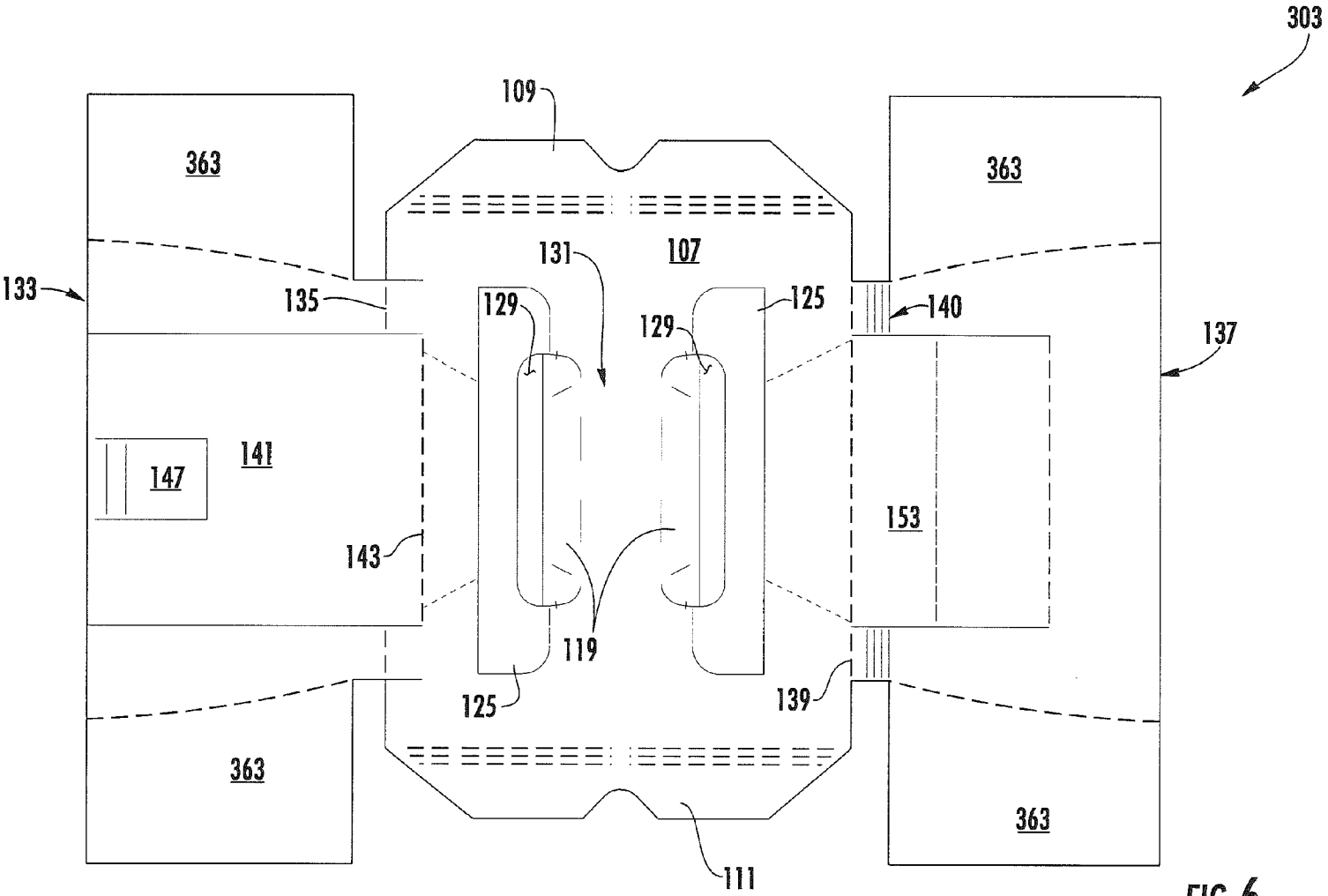
FIGS. 6-8 are plan views of respective alternative embodiments of the insert blank of FIG. 2.

FIG. 6 is a plan view of an insert blank 303 for forming an insert (not shown) according to an alternative embodiment of the disclosure. The insert 303 is generally similar to the insert 103 of the first embodiment, except for variations noted and variations that will be apparent to one of ordinary skill in the art. Accordingly, similar or identical features of the embodiments have been given like or similar reference numbers. As shown in FIG. 6, the corner flaps 363 are larger and have a more rectangular shape than the corner flaps 163 of FIG. 2. The insert blank 303 could be otherwise shaped, arranged, and/or configured without departing from the disclosure.

Figure 7:
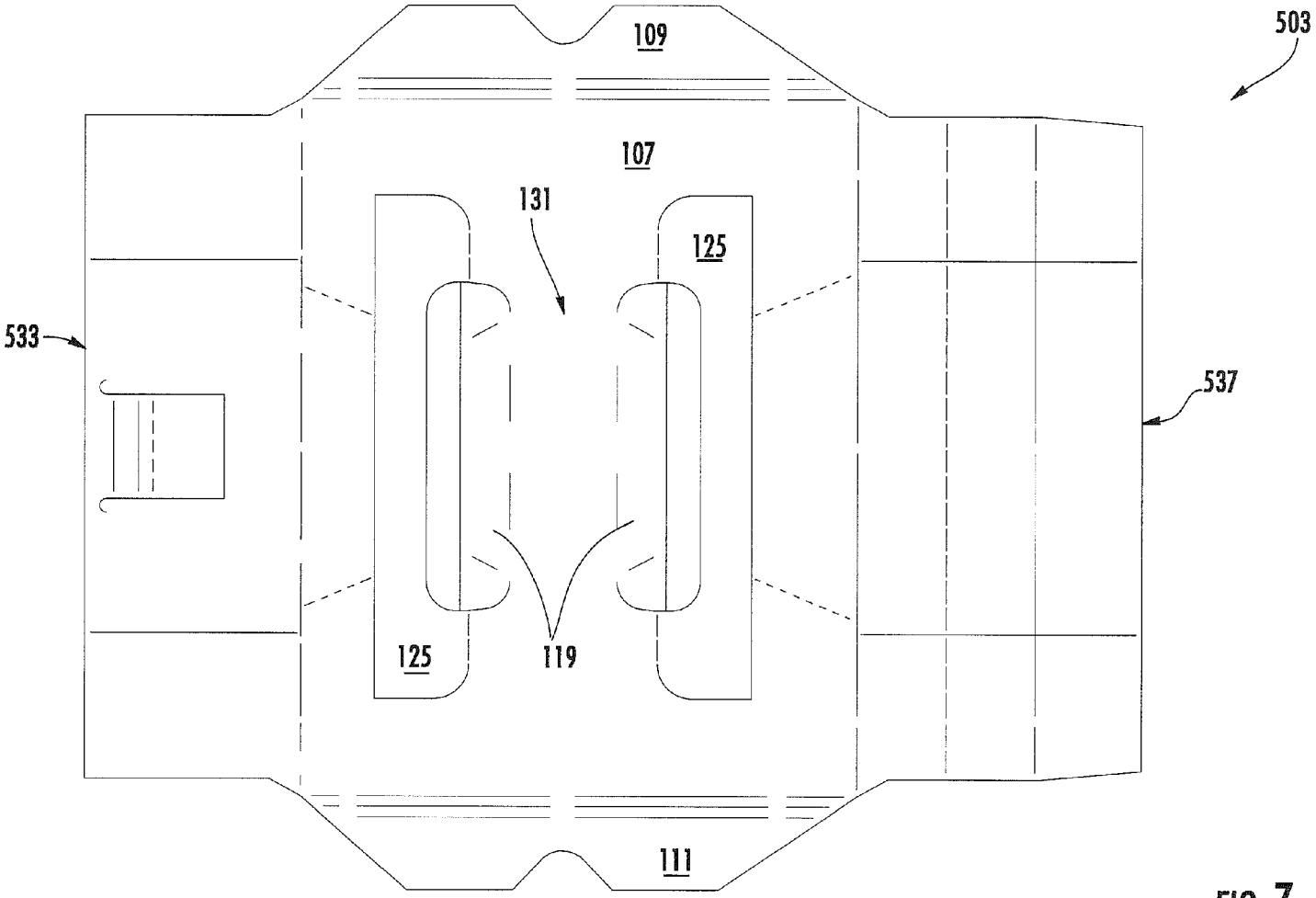

FIG. 7 is a plan view of an insert blank 503 for forming an insert (not shown) according to an alternative embodiment of the disclosure. The insert 503 is generally similar to the insert 103 of the first embodiment, except for variations noted and variations that will be apparent to one of ordinary skill in the art. Accordingly, similar or identical features of the embodiments have been given like or similar reference numbers. As shown in FIG. 7, the inner side panels 533, 537 have an alternative shape and configuration of fold lines and do not extend beyond the central panel 107. The insert blank 503 could be otherwise shaped, arranged, and/or configured without departing from the disclosure.

Figure 8:
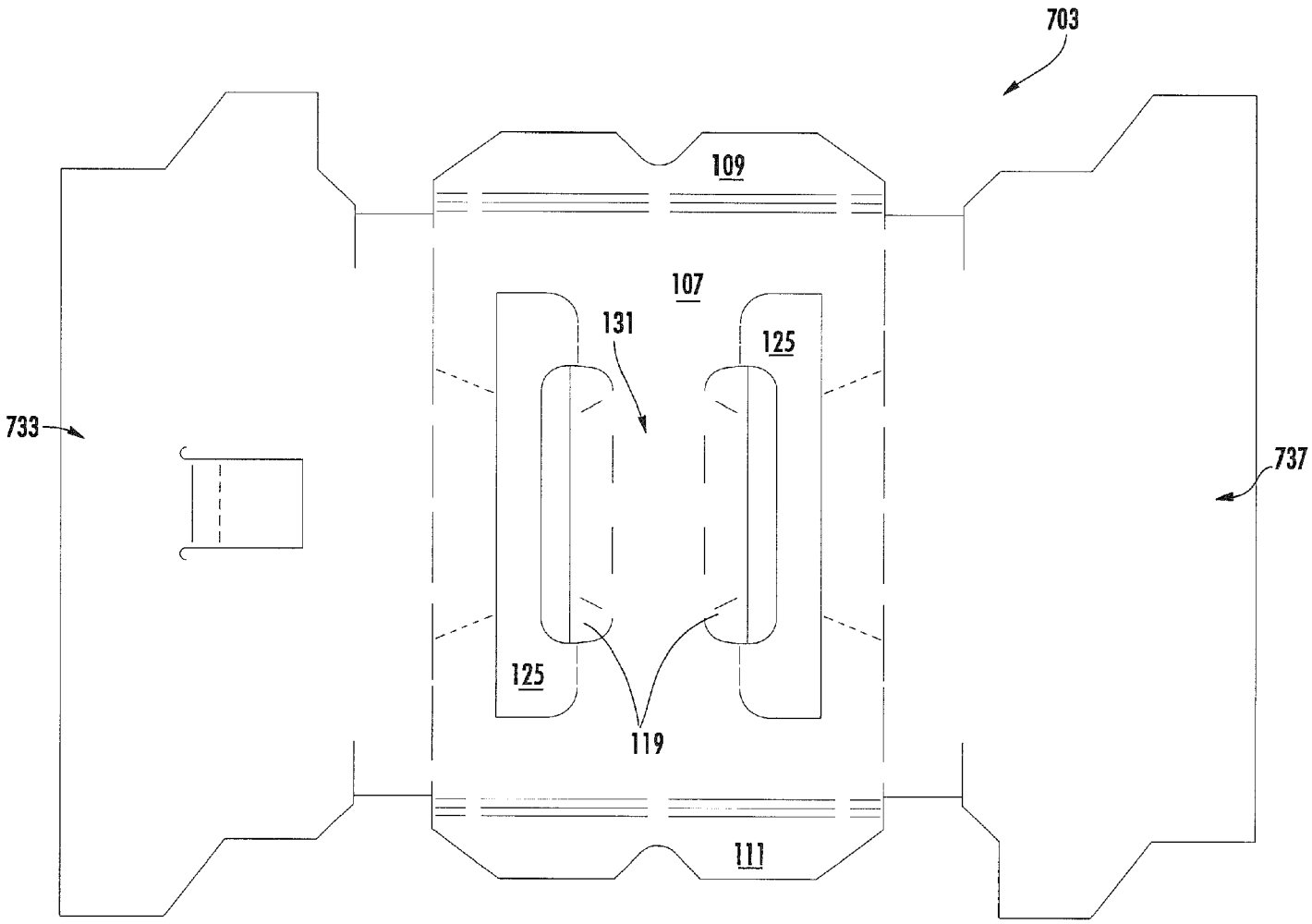

FIG. 8 is a plan view of an insert blank 703 for forming an insert (not shown) according to an alternative embodiment of the disclosure. The insert 703 is generally similar to the insert 103 of the first embodiment, except for variations noted and variations that will be apparent to one of ordinary skill in the art. Accordingly, similar or identical features of the embodiments have been given like or similar reference numbers. As shown in FIG. 8, the inner side panels 733, 737 have an alternative shape and configuration of fold lines. The insert blank 703 could be otherwise shaped, arranged, and/or configured without departing from the disclosure.

The cartons of any of the illustrated or non-illustrated embodiments of the disclosure could have other or additional features (e.g., dispenser features, handle features, reinforcement features, etc.) without departing from the disclosure. Also, the cartons could be otherwise shaped, arranged, or configured and the cartons could be configured to hold articles other than beverage containers C without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprises a top panel, and a side panel; and an insert comprising a central panel, an inner side panel foldably connected to the central panel, and a crown retention panel foldably connected to the central panel;

wherein the top panel at least partially overlaps the central panel, at least a portion of the crown retention panel is spaced apart from the side panel in the interior of the carton, and the inner side panel is at least partially in face-to-face contact with the side panel, wherein the crown retention panel is foldably connected to the central panel along a first lateral fold line that is spaced apart from the side panel and is foldably connected to the inner side panel along a second lateral fold line, and the insert comprises a spacer portion foldably connected to the central panel along a third lateral fold line and foldably connected to the inner side panel along a fold area, the third lateral fold line being spaced apart from the side panel.

2. The carton of claim 1, wherein the crown retention panel is positioned for contact with at least one container of the plurality of containers.

3. The carton of claim 1, the crown retention panel extends generally downwardly from the central panel and is spaced apart from the inner side panel.

4. The carton of claim 1, wherein the side panel is a first side panel and the crown retention panel is a first crown retention panel, the carton further comprising a second side panel, and the insert further comprising a second crown retention panel that is foldably connected to the central panel and is spaced apart from the second side panel.

5. The carton of claim 4, wherein the second crown retention panel comprises an attachment flap at least partially in face-to-face contact with the second side panel.

6. The carton of claim 4, wherein the inner side panel is a first inner side panel, and the insert further comprises a second inner side panel foldably connected to the central panel and at least partially in face-to-face contact with the second side panel, the second crown retention panel being at least partially spaced apart from the second inner side panel.

7. The carton of claim 1, further comprising a plurality of end flaps respectively foldably connected to respective panels of the plurality of panels, the plurality of end flaps being at least partially overlapped with respect to one another to thereby at least partially form a closed end of the carton, wherein the insert further comprises a corner flap foldably connected to the inner side panel, the corner flap at least partially overlapping the closed end of the carton.

8. The carton of claim 1, further comprising a plurality of end flaps respectively foldably connected to respective panels of the plurality of panels, the plurality of end flaps being at least partially overlapped with respect to one another to thereby at least partially form a closed end of the carton, and wherein the insert comprises an inner end flap foldably connected to the central panel proximate the closed end.

9. The carton of claim 4, wherein the insert comprises an attachment flap foldably connected to the second crown retention panel, at least a portion of the attachment flap being attached in face-to-face contact with the second side panel.

10. The carton of claim 1, further comprising a dispenser comprising an outer dispenser pattern and an inner dispenser pattern, wherein:

the outer dispenser pattern comprises an outer dispenser panel extending in at least the top panel and the side panel, the outer the dispenser panel being at least partially defined by an outer tear line extending in at least the top panel and the side panel; and the inner dispenser pattern comprises an inner tear line extending in at least the central panel.

11. The carton of claim 1, further comprising a handle extending in at least the top panel and the central panel.

12. The carton of claim 11, wherein the handle comprises a first outer handle flap and a second outer handle flap, each foldably connected to an outer grip portion in the top panel.

13. The carton of claim 12, wherein the handle further comprises a first inner opening and a second inner opening in the central panel, each of the first inner opening and the second inner opening being generally aligned with the respective first outer handle flap and the second outer handle flap.

14. The carton of claim 12, wherein the handle further comprises a first inner handle flap and a second inner handle flap, each foldably connected to an inner grip portion in the central panel, the first outer handle flap, the second outer handle flap, and the outer grip portion at least partially overlapping the respective first inner handle flap, second inner handle flap, and inner grip portion.

15. The carton of claim 11, wherein the handle comprises an outer handle flap foldably connected to an outer grip portion in the top panel, an inner handle opening in the central panel that is at least partially aligned with the outer handle flap, an inner grip portion extending in the central panel, and a handle reinforcement flap foldably connected to the central panel, the handle reinforcement panel at least partially overlapping the inner grip portion, and the outer grip portion at least partially overlapping the handle reinforcement flap and the inner grip portion.

16. The carton of claim 15, wherein the handle further comprises an inner handle flap foldably connected to the inner grip portion of the central panel adjacent the inner handle opening.

17. The carton of claim 1, wherein the inner side panel is adhered to the side panel and is in a generally parallel planar relationship with the side panel.

18. In combination, a carton blank and an insert blank for forming a carton for holding a plurality of containers:

the carton blank comprising a plurality of panels comprising a top panel, and a side panel; and the insert blank comprising a central panel, an inner side panel foldably connected to the central panel, and a crown retention panel foldably connected to the central panel;

wherein the top panel at least partially overlaps the central panel, at least a portion of the crown retention panel is for being disposed in a position that is spaced apart from the side panel when the carton is formed from the carton blank and the insert blank, and the inner side panel is disposed at least partially in face-to-face contact with the side panel, wherein the crown retention panel is foldably connected to the central panel along a first lateral fold line that is spaced apart from the side panel and is foldably connected to the inner side panel along a second lateral fold line, and the insert blank comprises a spacer portion foldably connected to the central panel along a third lateral fold line and foldably connected to the inner side panel along a fold area.

19. The combination of claim 18, wherein the crown retention panel is for being positioned to be in contact with at least one container of the plurality of containers when the carton is formed from the carton blank and the insert blank.

20. The combination of claim 18, wherein the crown retention panel is at least partially separable from at least the inner side panel along a cut line.

21. The combination of claim 18, wherein the side panel is a first side panel and the crown retention panel is a first crown retention panel, the carton blank further comprising a second side panel, and the insert blank further comprising a second inner side panel comprising a second crown retention panel foldably connected to the central panel, at least a portion of the second crown retention panel being at least partially separable from at least the second inner side panel, and the second crown retention panel is for being disposed in a position that is spaced apart from the second side panel when the carton is formed from the carton blank and the insert blank.

22. The combination of claim 21, wherein the second crown retention panel comprises an attachment flap at least partially in face-to-face contact with the second side panel.

23. The combination of claim 21, wherein the second inner side panel is foldably connected to the central panel and at least partially in face-to-face contact with the second side panel.

24. The combination of claim 18, further comprising a plurality of end flaps respectively foldably connected to respective panels of the plurality of panels, the plurality of end flaps are for being at least partially overlapped with respect to one another to thereby at least partially form a closed end of the carton formed from the carton blank and the insert blank, and wherein the insert blank further comprises a corner flap foldably connected to the inner side panel, the corner flap at least partially overlapping at least one end flap of the plurality of end flaps.

25. The combination of claim 18, further comprising a plurality of end flaps respectively foldably connected to respective panels of the plurality of panels, the plurality of end flaps comprises at least a top end flap foldably connected to the top panel, and wherein the insert blank comprises an inner end flap foldably connected to the central panel and at least partially overlapping the top end flap.

26. The combination of claim 21, wherein the insert blank comprises an attachment flap foldably connected to the second crown retention panel, at least a portion of the attachment flap being attached in face-to-face contact with the second side panel.

27. The combination of claim 18, further comprising a dispenser comprising an outer dispenser pattern and an inner dispenser pattern, wherein:

the outer dispenser pattern comprises an outer dispenser panel extending in at least the top panel and the side panel, the outer the dispenser panel being at least partially defined by an outer tear line extending in at least the top panel and the side panel; and the inner dispenser pattern comprises an inner tear line extending in at least the central panel.

28. The combination of claim 18, further comprising a handle extending in at least the top panel and the central panel.

29. The combination of claim 28, wherein the handle comprises:

a first outer handle flap and a second outer handle flap, each foldably connected to an outer grip portion in the top panel; and a first inner handle flap and a second inner handle flap, each foldably connected to an inner grip portion in the central panel;

wherein the first outer handle flap, the second outer handle flap, and the outer grip portion at least partially overlapping the respective first inner handle flap, second inner handle flap, and inner grip portion.

30. The combination of claim 28, wherein the handle comprises an outer handle flap foldably connected to an outer grip portion in the top panel, an inner handle opening in the central panel that is at least partially aligned with the outer handle flap, an inner grip portion extending in the central panel, and a handle reinforcement flap foldably connected to the central panel, the handle reinforcement panel at least partially overlapping the inner grip portion, and the outer grip portion at least partially overlapping the handle reinforcement flap and the inner grip portion.

31. A method of forming a carton for holding a plurality of containers, the method comprising:

obtaining a carton blank comprising a plurality of panels comprising a top panel and a side panel;

obtaining an insert blank comprising a central panel, an inner side panel foldably connected to the central panel, and a crown retention panel foldably connected to the central panel, wherein the crown retention panel is foldably connected to the central panel along a first lateral fold line and is foldably connected to the inner side panel along a second lateral fold line, and the insert blank comprises a spacer portion foldably connected to the central panel along a third lateral fold line and foldably connected to the inner side panel along a fold area;

positioning the insert blank relative to the carton blank so that the top panel at least partially overlaps the central panel and the inner side panel is at least partially in face-to-face contact with the side panel; and forming an interior of the carton at least partially defined by the plurality of panels, the forming the interior of the carton comprising forming an open-ended sleeve, and the forming the interior of the carton causing at least a portion of the crown retention panel and the first lateral fold line to be disposed in a position that is spaced apart from the side panel in the interior of the carton.

32. The method of claim 31, further comprising loading the plurality of containers into the interior of the carton, at least one of the containers of the plurality of containers contacting the crown retention panel.

33. The method of claim 31, wherein the positioning the insert blank comprises disposing the crown retention panel at least partially in face-to-face contact with at least a portion of the top panel and the side panel, and the forming the interior of the carton causes at least a portion of the crown retention panel to fold relative to the central panel away from the side panel and the top panel.

34. The method of claim 31, wherein the positioning the insert blank further comprises attaching at least a portion of an attachment flap to a second side panel.

35. The method of claim 31, wherein the forming the interior of the carton causes the crown retention panel to fold along the first fold line and the second fold line.

36. The method of claim 31, wherein at least a portion of the crown retention panel is separable from at least the inner side panel along a cut line, the forming the interior of the carton causing the crown retention panel to at least partially separate from the inner side panel along the cut line as the crown retention panel is folded relative to the top panel.

* * * * *